US009015880B1

(12) United States Patent
Cauthen et al.

(10) Patent No.: US 9,015,880 B1
(45) Date of Patent: Apr. 28, 2015

(54) MANUAL TRANSFER VEST

(71) Applicants: Peggy S. Cauthen, Bradenton, FL (US); Cathy J. Foster, Collierville, TN (US)

(72) Inventors: Peggy S. Cauthen, Bradenton, FL (US); Cathy J. Foster, Collierville, TN (US)

( * ) Notice: Subject to any disclaimer, the term of this patent is extended or adjusted under 35 U.S.C. 154(b) by 0 days.

(21) Appl. No.: 13/901,507

(22) Filed: May 23, 2013

(51) Int. Cl.
*A41D 13/00* (2006.01)
*A61G 7/10* (2006.01)

(52) U.S. Cl.
CPC ..... *A61G 7/1038* (2013.01); *A41D 13/0007* (2013.01)

(58) Field of Classification Search
CPC ..... A41D 13/0007; A41D 13/1236; A41F 19/00; A41F 19/002; A41F 19/007; A41F 19/025; A41B 13/10
USPC ..... 5/81.1 T, 81.1 R, 89.1, 83.1; 2/114, 75
See application file for complete search history.

(56) References Cited

U.S. PATENT DOCUMENTS

| | | | | |
|---|---|---|---|---|
| 3,252,704 | A * | 5/1966 | Wilson | 482/68 |
| 6,122,778 | A * | 9/2000 | Cohen | 5/81.1 R |
| 6,240,564 | B1 * | 6/2001 | Te Kanawa | 2/115 |
| RE37,394 | E * | 10/2001 | Woodyard | 2/102 |
| 6,637,547 | B1 * | 10/2003 | Wydner | 182/3 |
| 6,892,395 | B2 * | 5/2005 | Schweer | 2/94 |
| 7,225,472 | B2 * | 6/2007 | McDonald et al. | 2/102 |
| 7,707,652 | B2 * | 5/2010 | Senegal | 2/102 |
| 7,945,975 | B2 * | 5/2011 | Thomas et al. | 5/81.1 T |
| 2009/0320188 | A1 * | 12/2009 | Johnson et al. | 2/455 |
| 2011/0283446 | A1 * | 11/2011 | Baldauf et al. | 2/462 |
| 2012/0137417 | A1 * | 6/2012 | Pease | 2/463 |
| 2012/0180205 | A1 * | 7/2012 | Herring | 2/463 |
| 2012/0324630 | A1 * | 12/2012 | O'Brien | 2/236 |
| 2014/0150161 | A1 * | 6/2014 | Nykoluk | 2/102 |
| 2014/0237698 | A1 * | 8/2014 | Murphy et al. | 2/69 |

* cited by examiner

*Primary Examiner* — Robert G Santos
*Assistant Examiner* — Myles Throop
(74) *Attorney, Agent, or Firm* — Dorothy S. Morse

(57) ABSTRACT

A manual transfer vest which aids in compensating for fatigue, pain, loss of strength, mobility, and energy in the daily life of a patient or individual/caregiver assisting the patient. It comprises soft, lightweight, and preferably washable material that enwraps the patient's torso, and also has at least two vertically-extending and non-adjustable hand-grip lift components with sturdy and durable construction and attachment. In most embodiments, six hand-grip lift components are used, with two upper front hand-grips preferably situated bilaterally in the clavicle/upper chest area of the patient, or the shoulder area, two lower front hand-grips situated bilaterally in the abdominal/mid-section area of the patient, and two upper back hand-grips located near the shoulders. For vest durability during repeated patient lifting, reinforcement lining material is also secured to the front exterior of the vest diagonally below hand-grips. Overall, the manual transfer vest promotes safety in preventing injuries, thereby reducing medical costs.

18 Claims, 6 Drawing Sheets

MANUAL TRANSFER VEST

CROSS-REFERENCES TO RELATED APPLICATIONS

None.

BACKGROUND OF THE INVENTION

1. Field of the Invention

The present invention relates to patient transfer systems and, particularly, to a manual patient transfer system in the form of a vest comprising several multi-functional patient assistive transfer features, which compensates at least in part for fatigue, pain, loss of strength, loss of mobility, and lack of energy in the daily life of moderately mobility-challenged patients or individuals who are still ambulatory but have difficulty in rising from a sitting position into a standing position.

2. Description of the Related Art

According to the CDC, each year in the United States one in three adults age 65 and older suffers a fall. The death rate from falls among older U.S. men and women has risen sharply, and falls are now their leading cause of early death. While not always being an immediate cause of death, falls can cause moderate to severe injuries, such as hip fractures and traumatic brain injuries, which accelerate death. Medical journals document that nursing homes with one hundred beds may annually experience as many as 100-200 patient falls. Other causes for nursing homes falls can include "transfer" difficulty (for example moving a patient from a bed to a chair), poor foot care, poor fitting shoes and improper or incorrect use of walking aids. In addition, medical journals and other publicly available medical information further documents that for the year 2000 the total annual estimated cost in the U.S. relating to nonfatal, fall-related injuries was at least $16 billion. For hip fractures alone, the average cost per patient during the first year of occurrence is at least $25,000, with a lifetime cost of sustaining a hip fracture approximately $81,300 (of which approximately half was spent on nursing home care). Every year, falls among older people cost the nation more than $20.2 billion in direct medical costs. Medicare costs for hip fractures are almost $3 billion annually. By 2020, the total annual cost of these injuries is expected to reach $32.4 billion. In addition, the high physical demands associated with the handling and moving of patients is probably the largest contributing factor to high rates of musculoskeletal disorders (MSD's) among practicing nurses and caregivers. Work-related MSD's, such as back and shoulder injuries, persist as the leading and most costly U.S. occupational health problem due to the cumulative effect of repeated manual patient-handling activities as well as patient transfers done in extreme static awkward postures. The present invention manual transfer vest is designed and constructed to assist practicing nurses and caregivers in handling and moving patients (obese and non-obese) without injury to themselves or to the patient, including patient fall prevention, with use contemplated by professionals and staff in hospitals, nursing homes, and assisted living facilities, but not limited thereto, as well as by people at home taking care of a family member.

In their observations as Registered Nurses, the inventors herein have found that in addition to obese populations, the elderly and disabled are in great need of transfer assistive devices that are better focused on transferring the patient with the highest level of comfort and safety possible, and also provide benefit to the caregiver by reducing the risk of caregiver MSD's. Without an assistive device, one or more people are needed to lift an individual into a standing position, typically using the arms. Particularly for elderly populations, as well as other populations who require assistance with ambulation, repeated pulling on the arms can be uncomfortable for individuals attempting to stand, and may lead to arm soreness and other injuries. Also, the disabled often do not have the muscular-skeletal capability or coordination to assist a caregiver during attempts to move them, which places more of a physical burden on the caregiver. The present invention transfer assistive device herein, in the form of a vest, is a non-mechanical device intended to reduce the risk and injuries associated with the populations mentioned hereinabove. The main objectives of the present invention are to promote patient safety, dignity, mobility and independence, which in turn will enhance their quality of life. The present invention has been developed with the safety, comfort and well-being of the patient and caregiver in mind. The above information demonstrates a current need for improved patient transfer, which can be fulfilled effectively and relatively inexpensively by use of the present invention vest, while also providing the additional benefit of lowering the rate of caregiver MSD's.

Use of the present invention manual transfer vest is not only contemplated for people attempting to rise from a seated position into a standing position when a risk of falling is greatly increased, but also for moderately mobility-challenged patients or individuals who are still ambulatory but in need of assistance while walking to prevent a fall. The front lifting components in the present invention vest assist a person standing in front of a seated patient to slowly, steadily, and in a controlled manner pull the seated patient toward them, until the seated patient has reached a standing position, with a combination of front and back lifting components being used by one or two caregivers to stabilize an ambulatory patient from one or both sides while walking occurs. Other patient transfers can also be assisted by present invention, such as but not limited to lateral bed transfers and repositioning maneuvers.

Many transfer assistive devices for patients and others are known. However, each has undesirable limitations. For instance, current manual patient transfer systems generally rely on various lifting and sliding techniques, which can cause great distress, discomfort, and uncertainty in the patient's safety, as well as possible injury to the caregiver. In addition, in some instances more than one caregiver is needed to assist one patient at a time, which takes away from the care of the other patients. Traditional mechanical solutions, such as floor-based hoists, ceiling lifts and lateral transfer systems have been shown to decrease the incidence of caregiver musculoskeletal injuries, but still present significant safety risks to patients. In addition, they have a high manufacturing cost and are not always practical in a home environment. Traditionally, mechanical solutions are also large, heavy and difficult to transport and often perform only one single transfer function. Two vest-like manual patient transfer devices are disclosed in U.S. Pat. No. 7,945,975 to Thomas (2011) and U.S. Pat. No. 6,122,778 to Cohen (2000). However, present invention structure is distinct from each of them. The Thomas invention is an elongated device having a central opening for the patient's head, and once the patient has placed his or her head through the opening, a front panel section will extend downwardly over the front of the patient and a rear panel section will extend downwardly over the back of the patient. To secure the Thomas device around a patient, its back panel section has a flap-like extension on each of its sides that each becomes extended across a different side of the patient for connection to the front panel section via hook-and-loop fasteners. The Thomas device has three front hand holds for patient lifting situated in a generally H-shaped configuration, one vertically-extending hand hold on each side of the patient between the shoulders and the abdominal area, and one horizontally-extending hand hold across the upper chest area of the patient. The Thomas invention also includes two diagonally-placed hand holds, one adjacent to each flap-like extension that extends downwardly across a different side of the patient. In contrast, the present invention makes a patient look and feel as if regular clothing is being worn, instead of a medical assist device, and the present invention also has three vertically-extending hand-grip lift components that are not pronounced or otherwise marked in any conspicuous manner, two stacked vertically above one another on its front and one on its back, which appear to a casual observer more as a design element on the vest, or a decorative enhancement, than a functional element. Furthermore, the present invention is different from the Thomas invention in that the present invention does not have a horizontally-extending front hand hold or any side hand holds. Although the Cohen invention is vest-like in appearance, it is also different from the present invention, having a grid of interconnected horizontally-extending and vertically-extending straps connected to the exterior surface of the vest that provide front lifting straps in both horizontal and vertical directions, rear lifting straps in both horizontal and vertical directions, vertical side lifting straps, and shoulder lifting straps. In addition, at least some of the straps in the Cohen invention are adjustable, and it does not give a patient the look and feel that conventional clothing is being worn, instead appearing mechanical and drawing attention to the patient's movement challenges if worn for extended periods of time. The present invention, which is intended to be worn continuously by patients while movement and mobility challenges exist, overcomes all of the disadvantages mentioned hereinabove for the prior art.

BRIEF SUMMARY OF THE INVENTION

The primary objective of this invention is to provide a manual patient transfer assistive device in the form of a vest that is able to transfer an elderly, disabled, or obese patient with the highest level of comfort and safety possible to the patient and the person aiding the patient. It is also an objective of this invention to provide a manual patient transfer assistive device that allows transfer of most elderly, disabled, and obese patients by one person. A further objective of this invention is to provide a manual patient transfer assistive device easily capable of achieving more than one patient transfer function. Another objective of this invention is to provide a manual patient transfer assistive device that allows patient transfers to be done in extreme static awkward postures without injury to the patient or the person aiding the patient. It is a further objective of this invention to provide a manual patient transfer assistive device that consists of well-designed, strong, and durable construction. Another objective of this invention is to provide a manual patient transfer assistive device that is made of soft, lightweight, and easily washable materials. It is also an objective of this invention to provide a manual patient transfer assistive device that is comfortable when a patient is seated and does not get in the way during use of a commode. In addition, it is an objective of this invention to provide a manual patient transfer assistive device that facilitates patient independence while maintaining dignity. A further objective of this invention is to provide a manual patient transfer assistive device for continuous or near continuous wear by moderately mobility-challenged patients, which has enhanced aesthetic appeal that does not visibly highlight a patient's movement challenges and instead makes patients feel as if they were wearing conventional and/or stylish clothing.

The present invention is a practical, efficient and well-designed manual multi-functional transfer device that is compact, lightweight, and easily capable of achieving more than one patient transfer function. It can be used with moderately mobility-challenged patients, and also used to promote a steady gait for safe patient ambulation. Using the manual transfer vest, one person usually can slowly, gently, evenly, steadily, and in a controlled manner, bring a seated patient into a standing position by pulling on the two lower vertically-extending and non-adjustable hand-grip lift components on the front of the vest that are closer to the abdominal/mid-section area of the person wearing the manual transfer vest. Should a patient be more difficult to maneuver, two people standing on opposite sides of a seated patient can bring the patient into a standing position by each simultaneously pulling on one of the upper front hand-grip lift components and on one of the upper back hand-grip lift components. Examples of other patient transfer activity that can be accomplished using the present invention include, but are not limited to, frontal transfers, lateral bed transfers, controlled stand-to-sit transitions, and repositioning maneuvers. The present invention manual transfer vest is made from flexible and durable material, which is also preferably lightweight for added patient comfort. However, for use in colder climates, the present invention manual transfer vest may comprise heavier material and/or more layers for added patient warmth. The preferred zippered or hook-and-loop front closure of the present invention manual transfer vest allows for easy on and off access while offering a comfortable fit. Raising a patient to a standing position using the hand-grip lift components of the present invention instead of patient arms, minimizes risk factors that can lead to patient or caregiver injury while increasing comfort for the patient wearing the manual transfer vest during needed transitions. To accommodate differing patient size, and provide a good fit for patient lifting and transfers, it is contemplated for the present invention manual transfer vest to be commercially available in more than one size. The manual transfer vest of the present invention helps to minimize risk factors that can lead to patient or caregiver injury, while also offering style and warmth. Its functionality further enhances a patient's or individual's safety, mobility, and stability during ambulation and transfer, while also facilitating independence and maintaining dignity. No invention is known having the same structure and providing the same benefits as the present invention.

COMPONENT LIST

Figure 1:
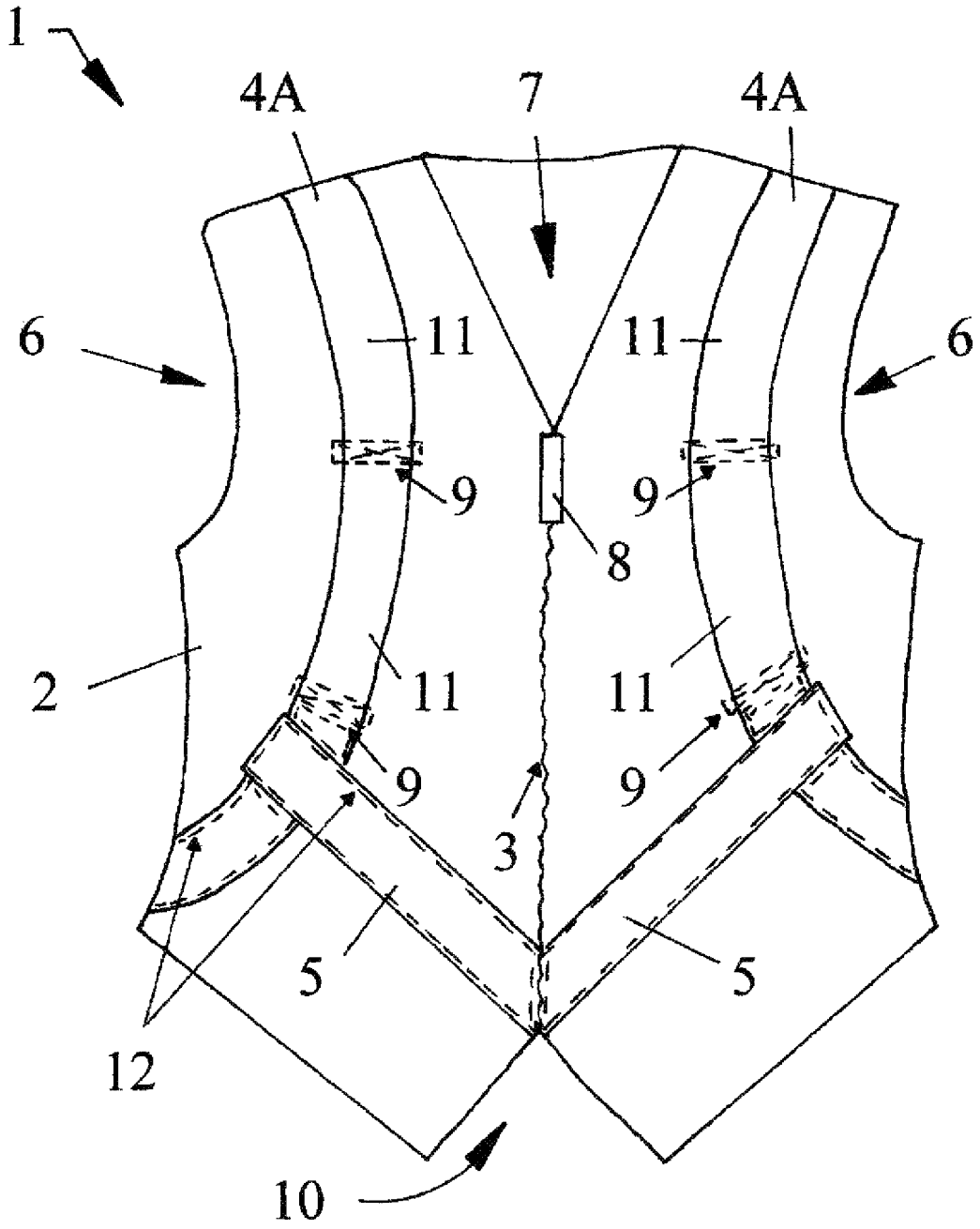
FIG. 1 is a front view of the most preferred embodiment of the present invention manual transfer vest with a zippered front closure and four frontal vertically-extending and non-adjustable hand-grip lift components, two of which are upper hand-grip lift components located in the clavicle/upper chest area adjacent to the shoulders of the person wearing the vest, and two of which are lower hand-grip lift components located lower on the vest closer to the abdominal/mid-section area of the person wearing the vest, with the vest also having reinforcement in key places for the hand-grip lift components to make certain that they remain strong during the lifting of heavy patients and patient lifting that occurs from static and sometimes awkward positions.

1—most preferred embodiment of manual transfer vest
2—front vest material
3—front closure (not limited to a zipper, also could be heavy duty hook-and-loop material, or other sturdy closure means, also although front centering of the closure is preferred, it is not critical)
4A—front portion of lifting strap
4B—back portion of lifting strap
5—angled reinforcement strap
6—enlarged arm hole
7—enlarged neck opening (for comfort and to prevent a sense of restriction around the neck should the vest material undergo any shift in position relative to patient during a transfer)
7'—back portion of enlarged neck opening
8—zipper pull (preferably enlarged for easier use)
9—stitched reinforcement area adjacent to hand-grip lift component 11
10—front void space for user comfort while seated (also allows the two opposed edges in the lower portion of front vest material 2 on each side of the void space to be easily grasped by the user or a caregiver to pull down front vest material 2 during or after a patient transfer is made so that the lower front part of enlarged neck opening 7 does not become, or remain, uncomfortably positioned against the patient's neck)
11—non-length-adjustable hand-grip lift component (created from a portion of lifting straps 4A/4B)
12—attachment stitching (used for securing lifting straps 4A/4B and angled reinforcement straps 5 to front vest material 2, securing lifting straps 4A/4B to front vest material 2 and back vest material 13, and securing interior lining material 15 to the shortened lower portion of vest back 14)
13—back vest material
14—shortened lower portion of vest back (prevents patient from sitting on vest and interference during use of a commode)
15—interior lining material (secured to front vest material 2 and back vest material 13)
16—user wearing manual transfer vest
17—reinforcement material (located in stitched reinforcement area 9 between front vest material 2 and back vest material 13)
18—side seam connecting front vest material 2 to back vest material 13 below armholes 6 (helps to secure the lower ends of front lifting straps 4A)

DETAILED DESCRIPTION OF THE INVENTION

Figure 2:
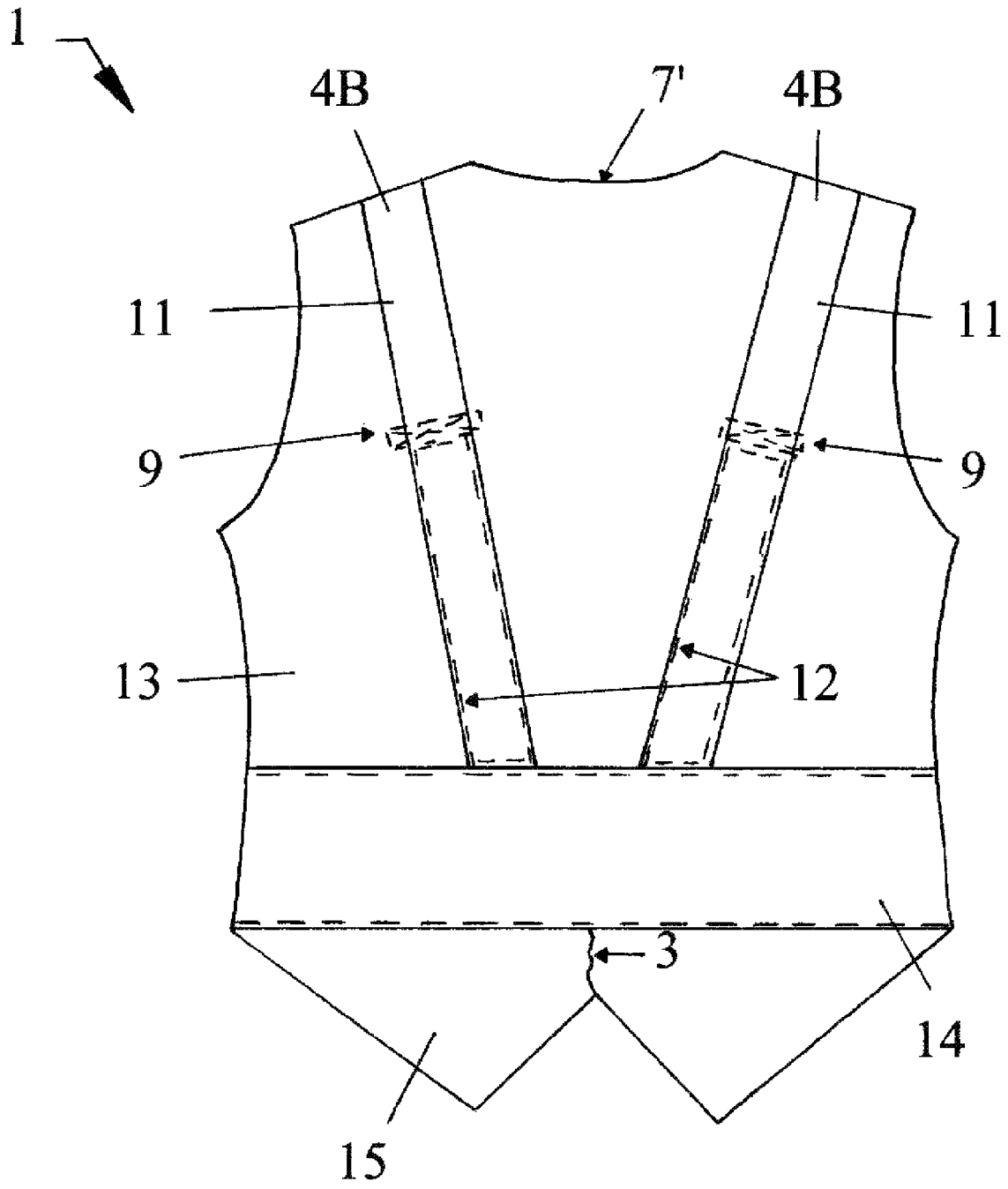
FIG. 2 is a rear view of the most preferred embodiment of the present invention showing two vertically-extending and non-adjustable upper hand-grip lift components located in the upper back area adjacent to the shoulders of the person wearing the manual patient transfer vest.
Figure 3:
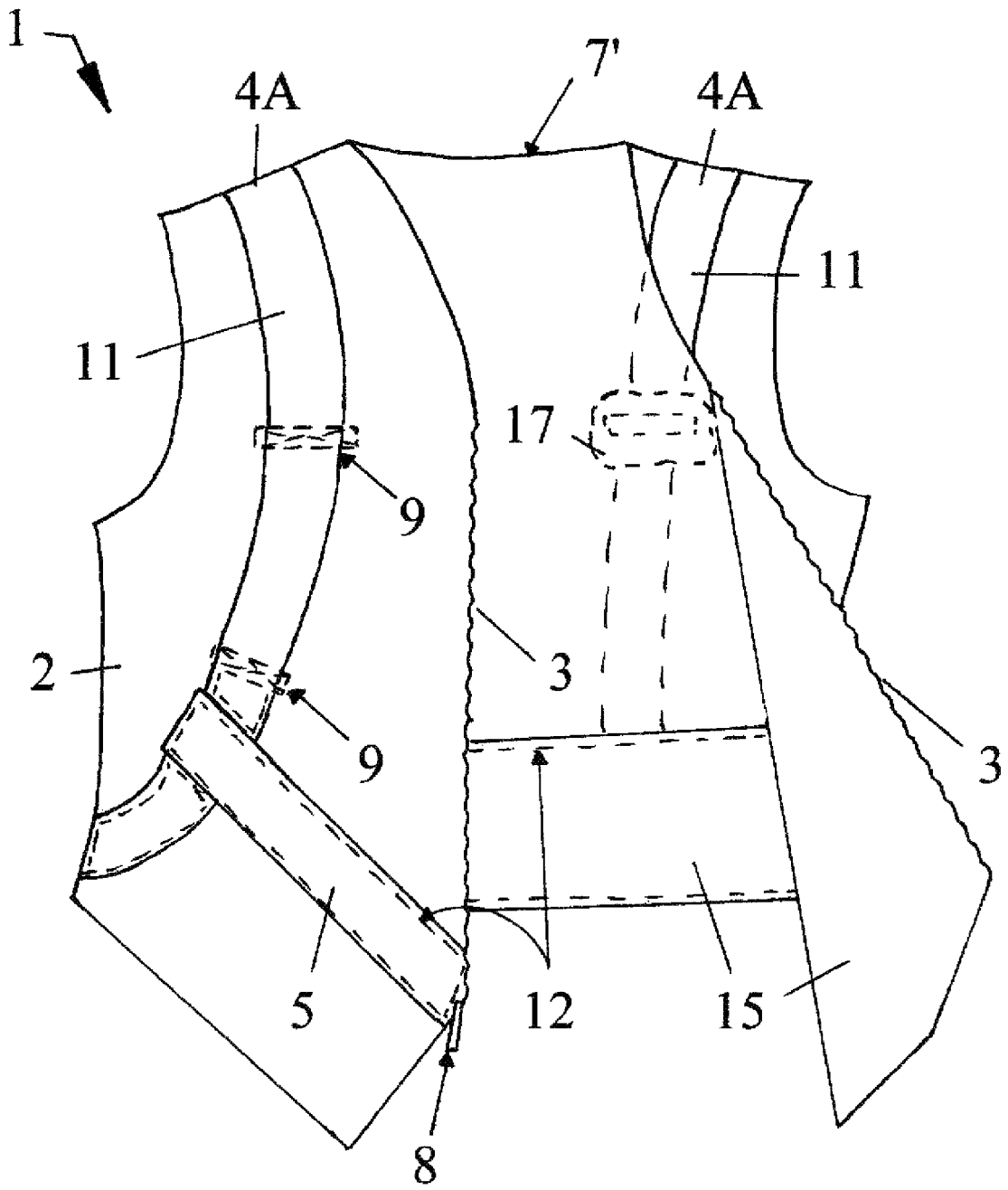
FIG. 3 is a front view of the most preferred embodiment of the present invention with the zipper unzipped and one side folded back to show the soft interior lining material.
Figure 4:
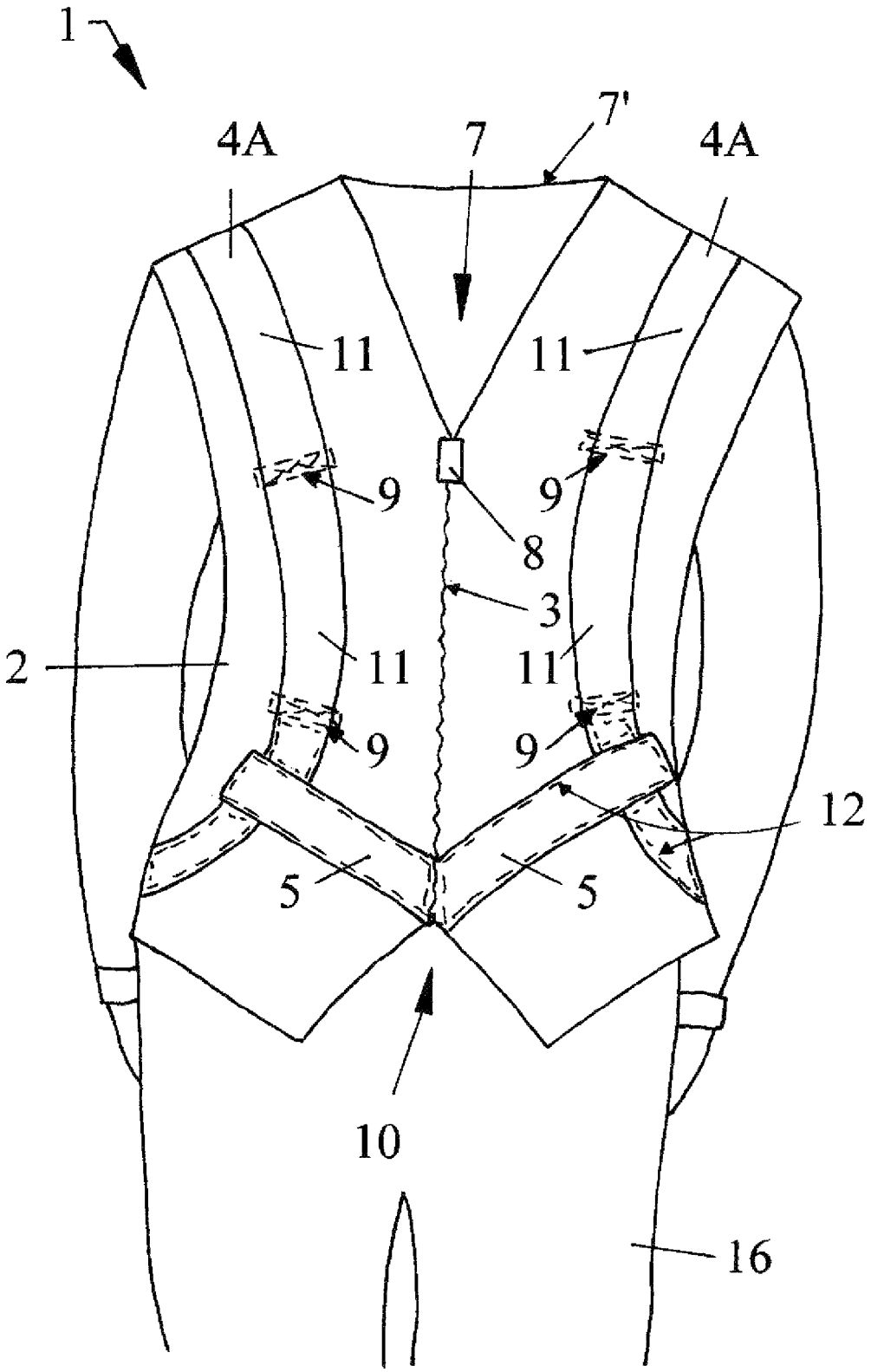
FIG. 4 is a front view of the most preferred embodiment of the present invention manual transfer vest on a person's torso, which shows the relative coverage desired in the vest material.
Figure 5:
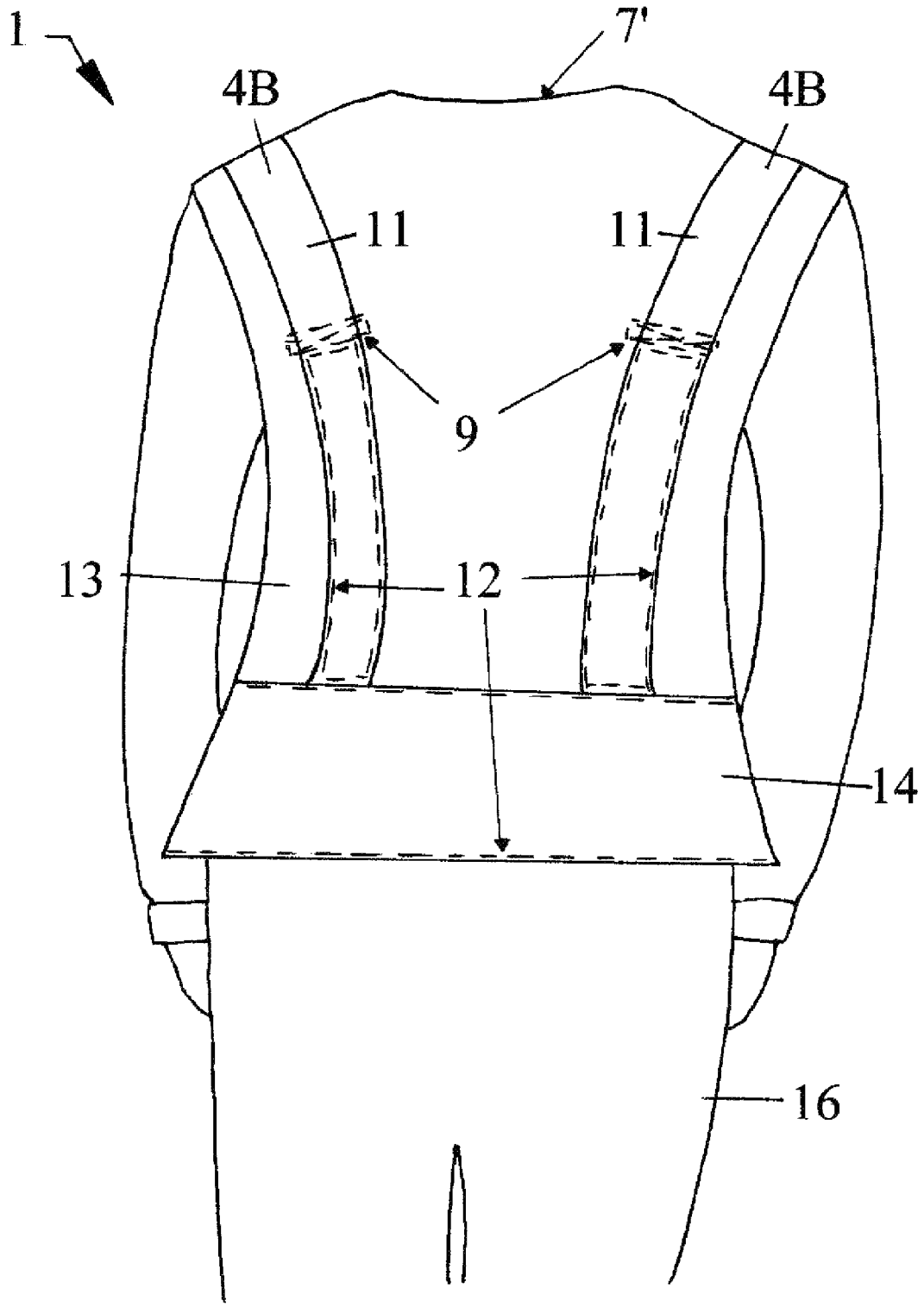
FIG. 5 is a rear view of the most preferred embodiment of the present invention manual transfer vest on a person's torso, which shows the relative coverage desired in the vest material.
Figure 6:
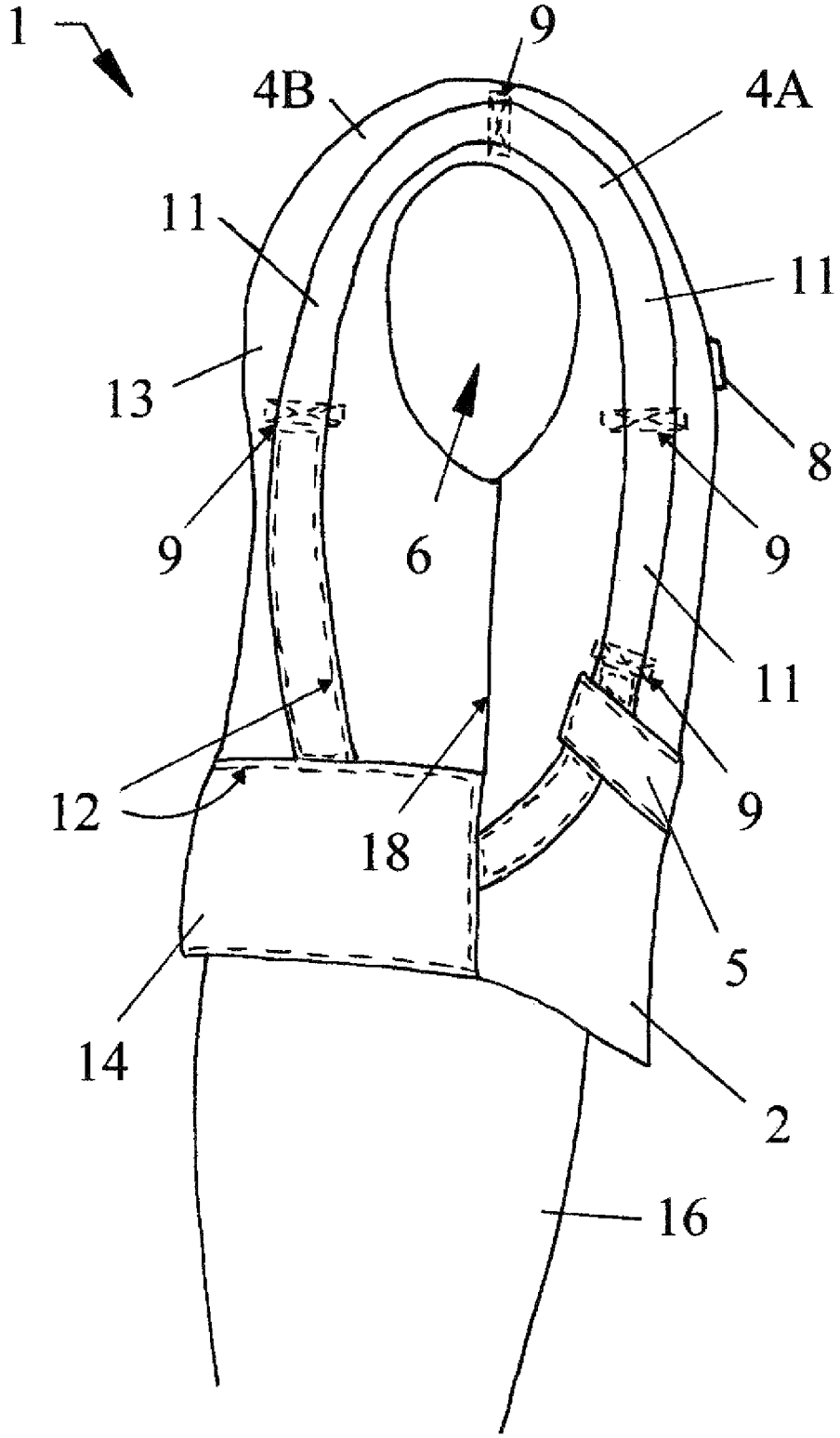
FIG. 6 is a side view of the most preferred embodiment of the present invention manual transfer vest on a person's torso, which shows the relative coverage provided by the vest material and the relationship of the front portion of the vest to the back portion, and also the lift strap preferably being in one piece.

The preferred embodiments of the present invention comprise a manual multi-functional patient transfer vest device (such as the most preferred vest 1 shown in FIG. 1-6) which has patient interfaces, such as but not limited to, the non-adjustable hand-grip lift components 11 shown in FIGS. 1-6, that can be employed for transferring moderately mobility-challenged patients (such as the user 16 shown in FIGS. 4-6). In one preferred embodiment, the multi-functional patient transfer vest device is a one-piece, sleeveless vest, with zippered or hook-and-loop front closure means, that fits snugly and covers the patient's upper back, mid-chest, and waist areas, but does not interfere with a patient's use of a commode. The front of the multi-functional patient transfer device has four sturdy and durable vertical, non-adjustable hand-grip lift components 11, with two hand-grip lift components 11 secured bilaterally to the front vest material 2 and extending across the clavicle/upper chest area or shoulder area, with the other two front hand-grip lift components 11 secured bilaterally to the front vest material 2 and extending across the abdominal/mid-section area. In addition, it is also preferred for two more hand-grip lift components 11 to be secured bilaterally to the back vest material 13 and extending across the upper back or shoulder area. To create sturdy and durable hand-grip lift components 11 and secure attachment to front vest material 2 and back vest material 13, it is preferred for hand-grip lift components 11 to be made from one elongated lifting strap 4 (having a from portion 4A contiguous with a back portion 4B), and for lifting strap 4 to be secured via reinforced stitching 9 to front vest material 2 and back vest material 13, forming the needed hand-grip lift components 11 (as shown in FIGS. 1-6) where attachment stitching 12 is not placed.

Manual transfer vest 1 preferably comprises soft, durable, and flexible material to provide patient comfort, with stronger material used in larger sizes intended for heavier patients. However, the outer fabric of manual transfer vest 1 must also be sufficiently strong to support the patient without premature failure during repeat patient 16 lifts and other transfers. It is preferred for manual transfer vest 1 to have a lining 15, which can be made of materials that provide durability and comfort when the present invention is used. It is also preferred for manual transfer vest 1 to have a lining 15, which can be made of materials that provide additional warmth when the present invention is used in colder surroundings. In addition, and although not critical, it is preferred for the materials (2, 4, 13, and 15) used for manual transfer vest 1 to be machine washable and machine dryable. The hand-grip lift components 11 attached to manual transfer vest 1 can be made from the same material (2 and 13) used to construct the exterior main body of manual transfer vest 1. In the alternative, hand-grip lift components 11 may be made from different strong and durable strap 4 material as long as it is not stretchable or overly firm to diminish caregiver hand comfort. The most preferred material used for the outer/exterior fabric (2 and 13) of manual transfer vest 1 is Rip-Stop Nylon, sometimes referred to as a sports fabric. It is water-resistant, woven, and lightweight, with an imbedded grid designed to stop rips or tears from spidering and getting larger. Rip-Stop Nylon is made by weaving nylon threads throughout a base material in interlocking patterns (typically a grid) that stops any tear from spreading. The tough beating that Rip-Stop Nylon can take makes it ideal in applications where material failure is not an option, such as present invention manual transfer vest 1. Rip-Stop Nylon is also machine-washable in warm water without chlorine bleach or bleach-based cleaners. It can also be tumble dried on medium heat, with a cool iron used as required. Another material contemplated as an outer fabric (2 and 13) for manual transfer vest 1 is Cordura Nylon Fabric, which has a well-established reputation for toughness and durability. Cordura Nylon Fabric is also waterproof, abrasion-resistant, rot-resistant, and mildew-resistant when a clear Polyurethane coating is added. It is also known for its durability and resistance to tears and scuffs. Cordura Nylon Fabric is machine-washable in cold water using a mild detergent, however chlorine or bleach-based cleaners should be avoided. Oil or grease spilled on Cordura Nylon Fabric should first be treated with a dry cleaning solvent followed by a spray cleaner or detergent and water. Cordura Nylon Fabric is a quick-drying nylon fabric, and drying on low setting, or air drying, is preferred. A third preferred material for the outer fabric (2 and 13) of manual transfer vest 1 is Gabardine, which is a resilient and tightly woven fabric. Though traditionally made of wool, it is easy to find Garbardine in a polyester or polyester blend. Gabardine is also waterproof, tear-resistant, heat-resistant, and shrink-resistant. Polyester Garbardine can be machine-washed using cold water and a cold water rinse, or warm water with a cold water rinse. Since it is generally a fast-drying fabric, line drying is preferred.

It is also preferable for the interior lining material 15 for manual transfer vest 1 to be durable, soft, and machine washable. Other preferred choices for interior lining material 15 are that it not wear out easily and that it comprise natural textiles, such as cotton, wool or silk, or from synthetic fibers such as rayon or nylon. It is also preferred for interior lining material 15 to offer patient comfort and breathability, as well as be waterproof, shrink-resistant, and heat-resistant. Shrink-resistance is important so that manual transfer vest 1 continues to provide a snug fit around a patient 16, without binding. Lifting strap 4 (including front portion 4A and back portion 4B) preferably is one-piece, has an approximate two-inch width dimension, and is made from a durable polyester fabric, although lifting straps 4 may be made from the material selected for the outer fabric (2 and 13) of manual transfer vest 1, if suitable to the application. The thread used as stitching 12 to attach lifting strap 4 to front and back vest material (2, 13) is preferably a durable upholstery thread made from 100% polyester with a heat-resistant finish or a polyester blend. It is also preferred for manual transfer vest 1 to have a zipper closure 3 made from 100% polyester and a durable plastic that is strong and weatherproof, although other durable closures can be used, including but not limited to one or more hook-and-loop closures, oversized buttons, heavy-duty grippers, or heavy-duty snaps. Reinforcement material 17 (see FIG. 3) positioned under stitched reinforcement areas 9 between interior lining material 15 and front vest material 2 or back vest material 13 may be an additional layer of outer vest material (2, 13), or another material or fabric capable of strengthening the attachment of stitched reinforcement areas 9. Also, more than one layer of reinforcement material 17 (same or differing materials) may be used for strengthening any one, or all, of the stitched reinforcement areas 9.

The design and size of manual transfer vest 1 should allow easy-on and easy-off handling, while also providing a comfortable fit on the person requiring transfer so that each transfer made is smooth and conducted with enhanced patent comfort. The most preferred embodiment of the present invention manual transfer vest 1 is designed without gender preference, and is equally usable by both men and women, without any modification. Manual transfer vest 1 may also be made in solid colors to complement patient clothing, or from materials (2, 4, 13, or 15) that display a mixture of colors, textures, and/or designs for variety and/or enhanced aesthetic appeal, and although not shown, as a source of user convenience manual transfer vest 1 may comprise one or more exterior or interior pockets in various locations. Due to the need for a comfortable fit, as mentioned above, it is contemplated for manual transfer vest 1 to be made in a variety of sizes, such as but not limited to small, medium, large, and extra-large. Preferred dimensions for a small manual transfer vest 1 include a shoulder-to-shoulder dimension of approximately fourteen inches, a chest dimension of approximately nineteen inches, a hip dimension of approximately twenty inches, and a length dimension of approximately twenty-five inches. Similarly, preferred dimensions for a medium manual transfer vest 1 include a shoulder-to-shoulder dimension of approximately sixteen inches, a chest dimension of approximately twenty-two inches, and a length dimension of approximately twenty-six inches. In addition, preferred dimensions for a large manual transfer vest 1 include a shoulder-to-shoulder dimension of approximately eighteen inches, a chest dimension of approximately twenty-five inches, and a length dimension of approximately twenty-seven to twenty-eight inches, with preferred dimensions for an extra-large manual transfer vest 1 including a shoulder-to-shoulder dimension of approximately nineteen to twenty inches, a chest dimension of approximately twenty-six inches, and a length dimension of approximately twenty-nine to thirty inches. Larger sizes than those mentioned above could also be custom-ordered. As considered appropriate, large, extra-large, and even greater sizes of manual transfer vest 1 could have hand-grip lift components 11 with a larger width dimension than is used for small and medium sizes, and the number, placement, size, and/or stitching pattern used for stitched reinforcement areas 9 in any size of manual transfer vest 1 could also be different from that illustrated in FIGS. 1-6.

FIGS. 1-6 show the most preferred embodiment of the present invention manual transfer vest 1. FIG. 1 is a front view of manual transfer vest 1 with a zippered front closure 3 and four frontal and substantially vertically-extending (and non-adjustable) hand-grip lift components 11, two of which are upper hand-grip lift components 11 located in the clavicle/upper chest area adjacent to the shoulders of the person 16 wearing manual transfer vest 1, and two of which are lower hand-grip lift components 11 located lower on manual transfer vest 1 closer to the abdominal/mid-section area of the person 16 wearing it, with manual transfer vest 1 also having stitched reinforcement areas 9 in key places to strengthen hand-grip lift components 11 and make certain that hand-grip lift components 11 maintain their strength during the lifting of heavy patients and when patient lifting occurs from static and sometimes awkward positions. Hand-grip lift components 11 should be sufficiently large for an adult caregiver to comfortably insert all four fingers through it, but not too large so that the caregiver cannot establish proper leverage to assist the type of patient transfer needed. FIG. 1 also shows one angled reinforcement strap 5 secured across the lower end of each of the front lift strap portions 4A connected to front vest material 2 with attachment stitching 12, with each angled reinforcement strap 5 stitched across a different front lift strap portion 4A in a substantially perpendicular orientation thereto that provides enhanced strength for front lift strap portions 4A during patient transfers. Although only one reinforcement strap 5 is shown on each side of manual transfer vest 1, it is considered to be within the scope of the present invention for more than one reinforcement strap 5 to be used, particularly in larger custom-ordered manual transfer vests 1, but not limited thereto. Furthermore, the attachment stitching 12 shown in FIGS. 1-6 as examples of where it might be placed to secure the parts of front lift strap portion 4A not used as a hand-grip lift component 11 to front vest material 2, to secure the parts of back lift strap portion 4B not used as a hand-grip lift component 11 to back vest material 13, to secure angled reinforcement straps 5 to front lift strap portions 4A and front vest material 2, and to secure shortened lower portion of vest back 14 to back lift strap portion 4B, back vest material 13, and interior lining material 15, should not be considered as limiting, and the number of stitches-per-inch, placement, nearness to any material edge, and the number of rows of attachment stitching 12 used in any location may be different from that shown. Since the lower portion of each front lift strap portion 4A in FIGS. 1, 3-4, and 6 appears to curve downwardly and outwardly toward the sides of manual transfer vest 1, the needed curvature can be formed into front lift strap portions 4A during their manufacture, or provided as a result of making one or more darts or folds in front lift strap portions 4A under the part of the angled reinforcement strap 5 that becomes stitched across it. Furthermore, for comfort of the person 16 wearing it during standing-to-sitting transitions, FIG. 1 shows manual transfer vest 1 having preferred enlarged arm holes 6, an enlarged neck opening 7, and a front void space 10 positioned below zipper closure 3. As shown in FIG. 1, it is contemplated for front lift strap portions 4A to have substantially symmetrical placement laterally on front vest material 2 FIG. 2 is a rear view of manual transfer vest 1 showing two vertically-extending and non-adjustable upper hand-grip lift components 11 located in the upper back area adjacent to the shoulders of the person 16 wearing it, and vest back material 13 being shorter than front vest material 2 to assist person 16 in use of a commode without having to remove manual transfer vest 1. FIG. 2 also shows a separate shortened lower portion 14 stitched to vest back material 13, which helps to strengthen the connection of the lower ends of back lift strap portions 4B to vest back material 13 when transfer movement for patient 16 involves the use of either one of the hand-grip lift components 11 located on the upper portion of back strap components 4B associated with the upper back or shoulders of person 16. Furthermore, in FIG. 2, and also in FIGS. 3-5, the back portion of enlarged neck opening 7 is marked with the number 7'. FIG. 3 is a front view of manual transfer vest 1 with the front zipper closure 3 unzipped and one side folded back to show the soft interior lining material 15. FIG. 3 also shows the preferred reinforcement material 17 optionally positioned between interior lining material 15 and front vest material 2 (or back vest material 13) in the locations where stitched reinforcement areas 9 are used. The relative size of reinforcement material 17 to the stitched reinforcement area 9 that it strengthens may vary, as well as the number of layers of reinforcement material 17 used with each stitched reinforcement area 9. In addition, FIG. 3 shows the lining material 15 on the interior back portion of manual transfer vest 1 having a separate lower portion similar in size to the separate shortened lower portion 14 stitched to exterior vest back material 13, which also assists in securing and strengthening the connection between the lower ends of back lift strap portions 4B to vest back material 13 when transfer movement for patient 16 involves the use of either one of the hand-grip lift components 11 located on the portion of back lift components 4B. FIGS. 4-6 are respectively a front view, a back view, and a side view of manual transfer vest 1 on the torso of a person 16, all of which show the relative coverage of person 16 preferably provided by manual transfer vest 1. FIG. 5 is a rear view of manual transfer vest 1 on the torso of a person 16, which shows a shorter length for back vest material 13 than is used for front vest material 2. FIG. 6 is a side view of the most preferred embodiment of the present invention manual transfer vest 1 on the torso of a person 16, which shows the relationship of the front vest material 2 to back vest material 13, and also the preferred one-piece construction of each front-to-back-extending lift strap 4 (4A and 4B) from which three hand-grip lift components 11 are created, with one lift strap 4 extending up and over the right shoulder of the person 16 wearing it, and the second lift strap 4 extending up and over the left shoulder of person 16. FIG. 6 also shows the side seam 18 that connects front vest material 2 to back vest material 13 below armholes 6, which further help to secure the lower ends of front lifting straps 4A. Although not shown, it is contemplated for top stitching to be optionally used adjacent to any seam of manual transfer vest 1 or other preferred embodiment of the present invention, such as but not limited to armhole 6 seams where front vest material 2 and back vest material 13 are connected to lining material 15, enlarged neck hole 7/7' seams where front vest material 2 and back vest material 13 are connected to lining material 15, side seams 18 where front vest material 2 and back vest material 13 are connected to one another, front closure 3, and the bottom edges of front vest material 2 near the lower seam (not numbered in FIGS. 1-6) connecting it to lining material 15.

To use the present invention, the patient 16 first dons manual transfer vest 1 and its front closure 3 (preferably the zipper closure 3 shown in FIG. 1) is secured in a closed orientation so that manual transfer vest 1 completely enwraps the torso of patient 16 and provides a snug, but not too restrictive, fit around patient 16. For a frontal sit-to-stand transfer, patient 16 is in a sitting position. Using good body mechanics, the caregiver (not shown) stands with knees slightly bent and leaning slightly forward in front of patient 16. The caregiver then places each hand within a different hand-grip lift component 11 on opposite sides of front closure 3, and with ease and providing a controlled and gentle lift upward, the caregiver steadily assists patient 16 into a standing position. In contrast, for a lateral bed transfer, the caregiver would have patient 16 lie on his/her side and place both legs over the edge of the bed (not shown); then with ease and control, the caregiver would use the appropriate hand-grip lift component 11 (nearest the shoulder side down) to gently assist patient 16 to a sitting position. For a repositioning maneuver, the caregiver would align and reposition patient 16 at the head of the bed by placing one hand in each of two different hand-grip lift components 11 and with ease and control, gently pull patient 16 upward until positioned at the head of the bed. The repositioning maneuver can also be accomplished with a two-person assist. For promoting a steady gate during safe ambulation while walking along side of patient 16, the caregiver would place one hand through one hand-grip lift component 11 (front or back), which would steady the gait of patient 16 and thereby prevent him or her from falling. This safe ambulation maneuver can also be accomplished by a two-person assist, with one person walking on each side of patient 16 and each holding onto one or more hand-grip lift component 11 (front or back).

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned but still considered to be within the scope of the present invention. Therefore, the present invention should not be considered as limited to the above-described embodiments, methods, and examples, or the language in the accompanying Abstract, but instead considered to encompass all embodiments and methods within the scope and spirit of the invention, as defined in the accompanying claims.

We claim:

1. A manual transfer and lift garment allowing a caregiver to easily maneuver a patient from one position to another, said garment comprising:

a vest having a front exterior surface and a back exterior surface, said vest also having two armholes, a front closure with closed positioning allowing said vest to have a torso-surrounding orientation, and a neck opening the front portion of which has a V-shaped configuration when said front closure adopts said closed positioning;

two elongated front lifting straps each having a lower portion secured to said front exterior surface of said vest with attachment stitching, each said front lifting strap positioned at least in part between said neck opening and a different one of said armholes that results in positioning of said two front lifting straps on different sides of said front closure, each said front strap also securely attached to said front exterior surface with at least one stitched reinforcement area in a manner that creates at least one substantially vertically-extending front hand-grip lift component detached from said front exterior surface and non-adjustable in length, wherein said at least one stitched reinforcement area is positioned above and below each said hand-grip lift component;

two elongated back lifting straps secured to said back exterior surface of said vest, each said back lifting strap having an upper portion positioned at least in part between said neck opening and a different one of said armholes, each said upper portion of each said back strap also securely attached to said back exterior surface of said vest with at least one stitched reinforcement area in a manner that creates at least one substantially vertically-extending back hand-grip lift component detached from said back exterior surface and non-adjustable in length, and attachment stitching securely connecting parts of each said back strap not creating said at least one back hand-grip lift component to said back exterior surface of said vest; and at least two angled reinforcement straps each having opposing ends one of which extends across said lower portion of one of said front lifting straps, each said angled reinforcement strap also securely connected to said lower portion and said front exterior surface of said vest with attachment stitching, each said front lifting strap having at least one angled reinforcement strap attached there to, and each said angled reinforcement strap also positioned in substantially perpendicular orientation to the one of said front lifting straps to which it is secured, wherein when said vest is worn by an ambulatory patient with said front closure adopting said closed positioning, said front and back hand-grip lift components may be used by a caregiver in varying combinations for assisting patient ambulation to prevent falls, for patient movement and transfers, and to manually raise a patient from a seated position into a standing position.

2. The manual transfer and lift garment according to claim 1 wherein each said front lifting strap secured to said front exterior surface creates two hand-grip lift components one substantially above the other.

3. The manual transfer and lift garment according to claim 1 wherein at least one of said front lifting straps has unitary construction with one of said back lifting straps creating a continuous length.

4. The manual transfer and lift garment according to claim 1 wherein said back exterior surface has a shorter length dimension than that of said front exterior surface.

5. The manual transfer and lift garment according to claim 1 further comprising interior lining material connected to said front and back exterior surfaces and at least one layer of reinforcement material associated with at least one said stitched reinforcement area, and further wherein said at least one layer of reinforcement material is selected from a group consisting of reinforcement material situated between said lining material and said front exterior surface and reinforcement material situated between said lining material and said back exterior surface.

6. The manual transfer and lift garment according to claim 5 wherein said interior lining material is selected from a group consisting of soft material, flexible material, material preserving body warmth, breathable fabrics, durable fabrics, tear-resistant fabrics, washable fabrics, non-stretchable fabrics, fast-drying fabrics, waterproof fabrics, heat-resistant fabrics, shrink-resistant fabrics, mildew-resistant fabrics, and rot-resistant fabrics.

7. The manual transfer and lift garment according to claim 1 wherein said two back lifting straps each have a lower end and wherein said back exterior surface further comprises a separate lower portion connected to the remainder of said back exterior surface in a manner that secures said lower ends of said back lifting straps.

8. The manual transfer and lift garment according to claim 1 wherein said front closure comprises a centrally-positioned zipper.

9. The manual transfer and lift garment according to claim 8 wherein said front exterior surface has a void space below said centrally-located zipper.

10. The manual transfer and lift garment according to claim 1 wherein said hand-grip lift components each have a top end and a bottom end, and further wherein said at least one stitched reinforcement area is associated with said top and bottom ends.

11. The manual transfer and lift garment according to claim 1 wherein said front and back exterior surfaces are connected by side seams and said lower portions of said front lifting straps extend to and are secured in part by said side seams.

12. The manual transfer and lift garment according to claim 1 wherein said front and back lifting straps each have a minimum width dimension of approximately two inches.

13. The manual transfer and lift garment according to claim 1 wherein all parts of said front and back lifting straps not forming one of said hand-grip lift components are respectively secured to said front and back exterior surfaces by said attachment stitching.

14. The manual transfer and lift garment according to claim 1 wherein said arm openings are enlarged, promoting enhanced patient comfort.

15. The manual transfer and lift garment according to claim 1 wherein said neck area is enlarged, promoting enhanced patient comfort.

16. The manual transfer and lift garment according to claim 1 wherein said front and back exterior surfaces are made from materials selected from a group consisting of sturdy fabrics, strong fabrics, durable fabrics, tear-resistant fabrics, washable fabrics, woven fabrics, non-stretchable fabrics, fast-drying fabrics, waterproof fabrics, heat-resistant fabrics, shrink-resistant fabrics, mildew-resistant fabrics, rot-resistant fabrics, abrasion-resistant fabrics, a polyester blend, and nylon fabric.

17. A manual transfer and lift garment allowing a caregiver to easily maneuver a patient from one position to another, including from sitting to standing and from standing to walking, said garment comprising:

a vest having two large armholes, a central front closure with closed positioning allowing said vest to have a torso-surrounding orientation, a large neck opening the front portion of which has a V-shaped configuration when said front closure adopts said closed positioning, a back exterior surface with a separate shortened lower portion, and a front exterior surface with a void space below said central front closure and a length dimension greater than that of said back exterior surface, said front and back exterior surfaces connected below said armholes by side seams;

two elongated lifting straps each having one continuous length and extending across part of said front and back exterior surfaces of said vest, each said lifting strap having a front portion positioned at least in part between said neck opening and a different one of said armholes that results in a portion thereof being secured to said front exterior surface of said vest on different sides of said central front closure, at least one stitched reinforcement area securely attaching each said front portion to said front exterior surface of said vest in a manner that creates two substantially vertically-extending front hand-grip lift components each detached from said front exterior surface and non-adjustable in length, wherein said at least one stitched reinforcement area is positioned above and below each said hand-grip lift component, each said lifting strap also having a back portion positioned at least in part between said neck opening and a different one of said armholes and at least one stitched reinforcement area securely attaching each said back portion to said back exterior surface of said vest in a manner that creates one substantially vertically-extending back hand-grip lift component detached from said back exterior surface and non-adjustable in length, each said front portion having a lower end secured in part by a different one of said side seams, and attachment stitching securely connecting parts of each said front and back portions not creating said hand-grip lift components to said exterior surface of said vest, each said back portion additionally having a lower end secured by said separate shortened lower portion of said back exterior surface; and at least two angled reinforcement straps each having opposing ends one of which extends across said front portion of a different one of said elongated lifting straps near said lower end, each said reinforcement strap also securely connected to said one of said elongated lifting straps and to said front exterior surface of said vest with attachment stitching, each said angled reinforcement strap positioned in substantially perpendicular orientation to the one of said elongated lifting straps to which it is secured, wherein when said vest is worn by an ambulatory patient with said central front closure adopting said closed positioning, said front and back hand-grip lift components may be used by a caregiver in varying combinations for assisting patient ambulation to prevent falls, for patient movement and transfers, and to manually raise a patient from a seated position to a standing position.

18. The manual transfer and lift garment according to claim 17 further comprising interior lining material connected to said front and back exterior surfaces and at least one layer of reinforcement material associated with at least one said stitched reinforcement area, and further wherein said at least one layer of reinforcement material is selected from a group consisting of reinforcement material situated between said lining material and said front exterior surface and reinforcement material situated between said lining material and said back exterior surface.

* * * * *